US005346214A

United States Patent [19]

Bruhm

[11] Patent Number: 5,346,214

[45] Date of Patent: Sep. 13, 1994

[54] PUCK FOR USE BY IN LINE ROLLER SKATE HOCKEY PLAYERS

[76] Inventor: Todd Bruhm, 250 Woodland Acres Cres., Maple, Ontario, Canada, L6A 1G1

[21] Appl. No.: 140,438

[22] Filed: Oct. 25, 1993

[51] Int. Cl.[5] ..... A63B 71/00

[52] U.S. Cl. ..... 273/128 R

[58] Field of Search ..... 273/57.2, 126 R, 128 R, 273/128 CS, 424, 425

[56] References Cited

U.S. PATENT DOCUMENTS

| | | | |
|---|---|---|---|
| 4,793,769 | 12/1988 | Dolan | 273/128 R |
| 5,149,096 | 9/1992 | Keating et al. | 273/128 R |
| 5,184,820 | 2/1993 | Keating et al. | 273/128 R |

*Primary Examiner*—William H. Grieb
*Attorney, Agent, or Firm*—K. Maxwell Hill

[57] ABSTRACT

A hockey puck for use on surfaces having high friction resistances such as roads and streets consists of a hard rubber body similar to conventional ice hockey pucks and having Nylon like material fixed to both faces of the puck with knob-like protuberances projection outwardly of the puck faces to cause the puck to ride smoothly, like on ice, when shot across a road surface.

3 Claims, 2 Drawing Sheets

PUCK FOR USE BY IN LINE ROLLER SKATE HOCKEY PLAYERS

FIELD OF THE INVENTION

The present invention relates to an improvement in a game piece or puck as used by players wearing in line roller skates operating on a high friction surface such as a paved street or floor. In particular the invention is a hard rubber puck of the known shape and size having indented top and bottom surfaces and a plurality of holes punched or bored through the body of the puck from top to bottom surfaces to be filled with nylon when the puck is put in a mould and the nylon injected into the mould to fill the indented surfaces and the holes. The mould holding the puck has indentations formed in it adjacent the surfaces of the puck to form and make protuberances in the nylon surfaces formed by the nylon injected into the indented surfaces of the puck. When the nylon hardens and the puck is removed from the mould the projecting portions of the nylon surfaces will project above the rim of the puck to provide a riding surface to the combination when it contacts a road or other high friction surface. The holes through the body of the puck, when filled with hardened nylon will hold the nylon surfaces and their projecting protuberance from flying apart and off the puck when it is hit by a player's stick as in a "slap shot".

PRIOR ART

It is known to make floor hockey game pieces from different types of material and in different shapes. The most successful game piece is a ball but players have desired a game piece that simulates a hockey puck, in weight and action, that can be used on a rough surface such as a street. Fabric pucks with metal centres have been used but found dangerous, Rubber rimmed pucks with plastic centres are presently in use but the plastic often shatters when the rim is impacted by an unusually forceful strike of the hockey stick. Players wearing in line roller skates, often being ice hockey players, want a puck that simulates an ice hockey puck in every way including the feel of the impact of the stick and the ride and lift of the puck when shot and the feel of the puck when struck.

OBJECTS OF THE INVENTION

The principal object of the present invention is to provide a puck for use by roller hockey players that simulates an ice hockey puck in weight and ride on the rough surfaces of the play area such as a street or other paved area. Another object of the invention is to combine the hard rubber of a conventional ice hockey puck with plastic disc faces on the puck which will not shatter and break when the rubber edge is struck by a hockey stick as in normal play,

SUMMARY OF THE INVENTION

The game piece provided herein for use by roller hockey players consists of a disc shaped body of hard rubber having planar parallel end faces with a cylindrical peripheral wall. Hard plastic riding surfaces are inserted into each of the faces held in place by a lip of the rubber end wall, Hard plastic rivets pass through the game piece body joining together the riding surfaces and are integrally formed during injection moulding with the riding surfaces. To insure that the game piece does not ride on the playing field surface where the friction of the surface will drag on the rubber lip, a plurality of rises or protuberances extend upwards from the riding surfaces to become the primary contact of the puck with the road or playing surface.

IN THE DRAWINGS

With the foregoing objects in view and such other objects and novel features as may become apparent from consideration of this disclosure and specification the present invention consists of a concept which is comprised and embraced in the use and arrangement herein exemplified in the specific embodiment of the concept, reference being had to the accompanying drawings where like numerals refer to like parts.

THE EMBODIMENTS OF THE INVENTION AS DEPICTED IN THE DRAWINGS

Figure 1:
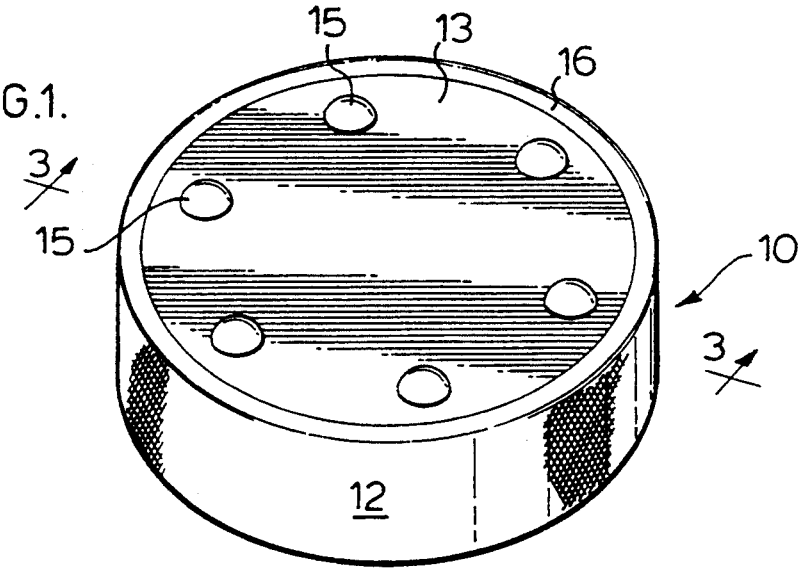
FIG. 1 is a perspective view taken from above, of the puck of the present invention.
Figure 2:
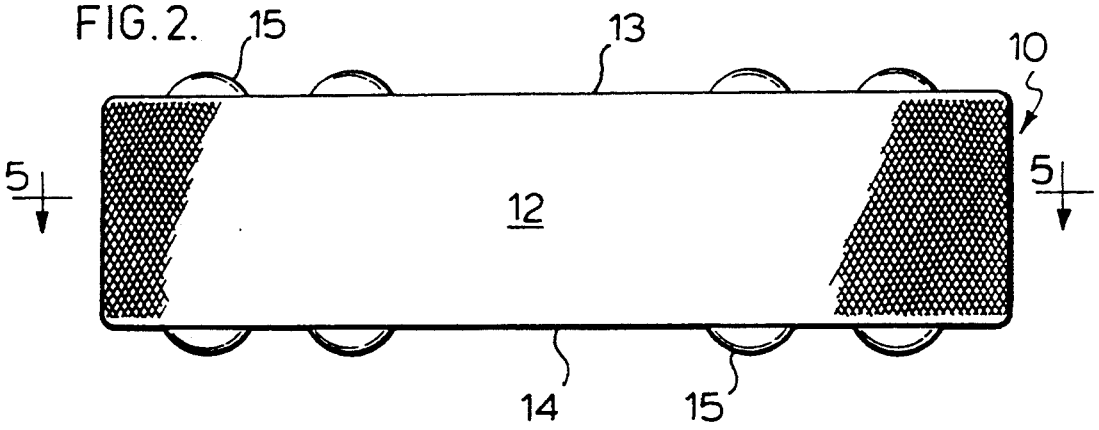
FIG. 2 is a side elevation view of the puck showing how the protuberances rise above the structure.
Figure 3:
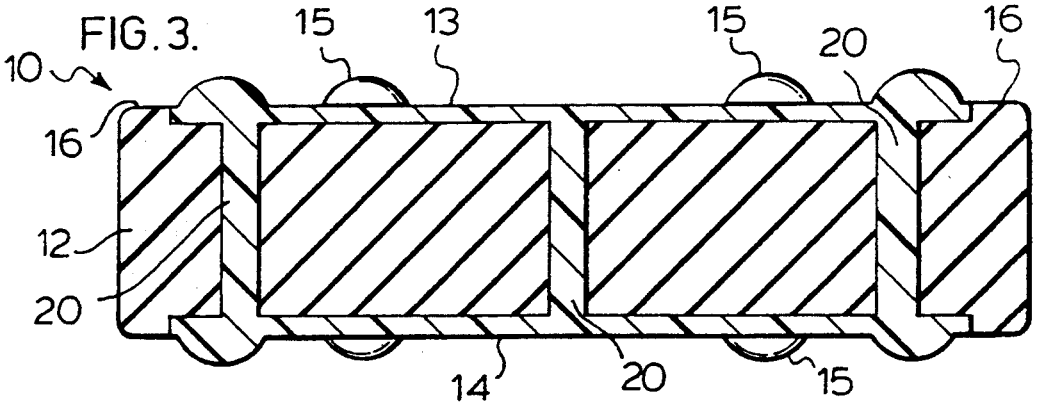
FIG. 3 is a cross sectional view to show how the top and bottom faces are integrally formed with the protuberances.
Figure 4:
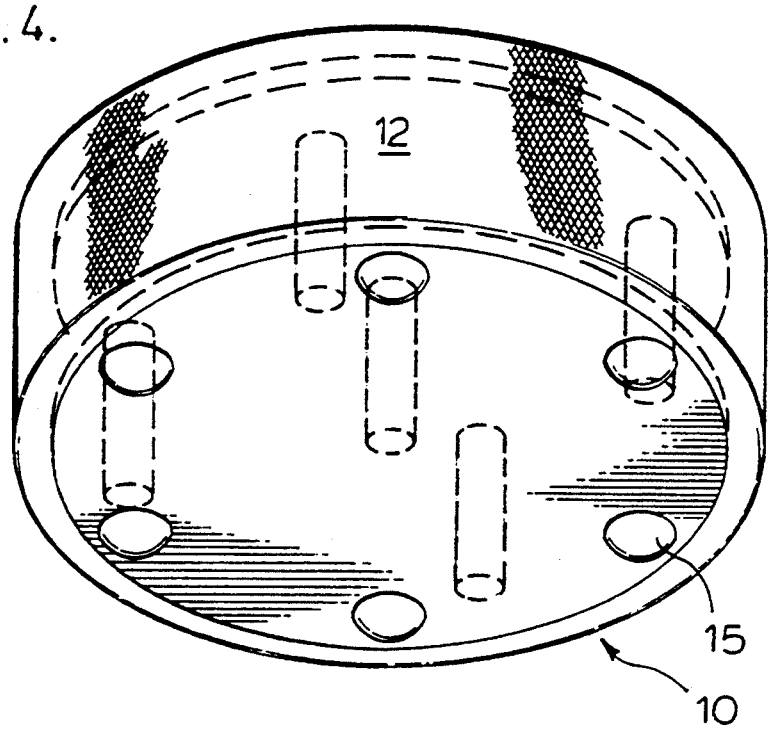
FIG. 4 shows, by section lines, how the plastic material is set into the rubber to provide the riding surfaces with the assistance of the protuberances.
Figure 5:
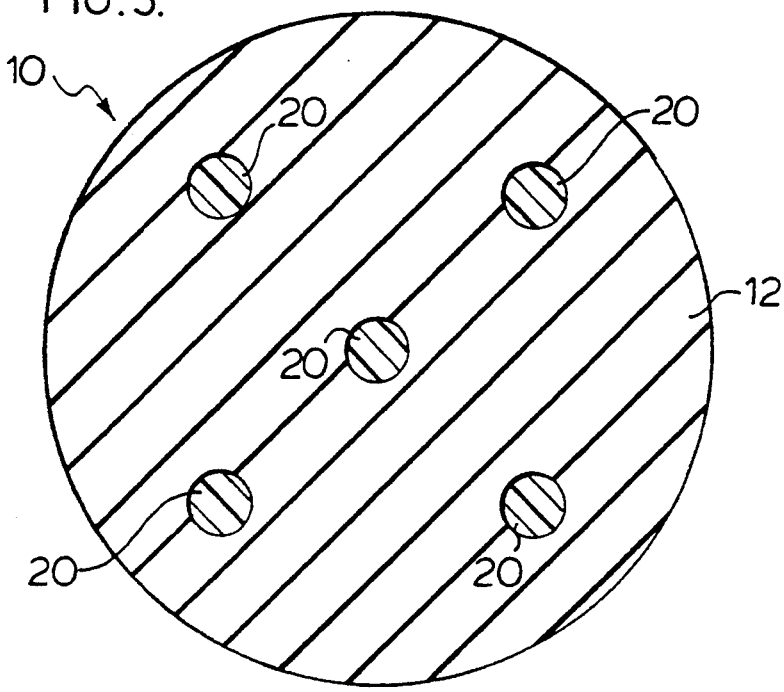
FIG. 5 is a view in section taken through the middle of the cylinder of the puck showing the manner of connecting the faces with the rivets and shows the rivets in section.

In the accompanying drawings like reference numerals refer to like parts, Numeral 10 is the game piece or puck of the invention and is shown as a disc shaped body having a cylindrical wall 12 and end faces 13,14. The end faces 13,14 are made of hard plastic such as Nylon and are inset into the faces of the puck 10 by the formation of a lip, flange or rim 16 extending upwards of the hard rubber body 12 of the puck 10. A plurality of knobs, studs or protuberances 15 are integrally formed of hard plastic with the faces 13,14 and protrude from the faces and above the rim 16. The riding surfaces, ends 13,14, are held fast together by joining spans or rivets 20 that are made of hard plastic and integrally formed in the mould with faces 13,14, and knobs 15. In the manufacture of the puck 10 of the invention a hard rubber puck body 12 is made with a rim or lip 16 and put in a mould having cavities on its inner surfaces facing the /puck ends and facing the cavity in the mould produced by the indenting of the puck during making of the rim 16 prior to introduction into the mould. A plurality of holes are bored through the faces of the puck prior to its introduction to the mould. A hard plastic material such as Nylon is injected into the mould in liquid form and will fill the bored holes to be rivets 20, faces 13,14 and knobs 15. When the plastic has hardened the puck with the plastic portions embedded in it is removed to provide the novel product herein claimed.

What I claim is:

1. A game piece for use by players using in-line roller skates on high friction surfaces such as roadways and streets comprising in combination; a disc shaped body having planar and parallel end faces and a cylindrical peripheral wall; said game piece being formed of hard rubber and having disc shaped hard plastic riding members covering said end faces to provide relative friction free sliding surfaces thereto;

said end face disc members being held together one with the other by hard plastic rivets passed through the game piece body and integrally formed with the disc face members; and having a lip formed and extending upwardly around the edge of each end piece of the game piece rubber body, to maintain with the action of the rivets, the riding surface members in position on the game piece when stuck by a player.

2. A game piece as claimed in claim 1 wherein a plurality of protuberances extend outwardly of the disc surfaces and beyond the lips of the rubber edges of the game piece to insure that the game piece will ride freely over the road surface.

3. A game piece as in claim 2 wherein the lips are of hard rubber and integrally formed with the game piece body and where the riding surface members and protuberances are made of nylon.

* * * * *